United States Patent [19]

Nakamura et al.

[11] Patent Number: 4,589,842

[45] Date of Patent: May 20, 1986

[54] DEVICE FOR ADJUSTING THE VERTICAL POSITION OF WICK IN OIL BURNER

[75] Inventors: Kazuharu Nakamura; Kazuhiko Takeuchi, both of Nagoya, Japan

[73] Assignee: Toyotomi Kogyo Co., Ltd, Aichi, Japan

[21] Appl. No.: 632,344

[22] Filed: Jul. 19, 1984

[30] Foreign Application Priority Data

Jul. 21, 1983 [JP] Japan ..... 58-113467[U]

[51] Int. Cl.[4] ..... F23D 3/34

[52] U.S. Cl. ..... 431/301; 431/307; 431/317; 126/96

[58] Field of Search ..... 431/88, 301, 304, 307, 431/315, 316, 317; 126/96

[56] References Cited

U.S. PATENT DOCUMENTS 4,424,019 1/1984 Nakamura et al. ..... 431/307

*Primary Examiner*—Margaret A. Focarino

*Attorney, Agent, or Firm*—Pollock, Vande Sande & Priddy

[57] ABSTRACT

A device for adjusting the vertical position of a wick in an oil burner is disclosed which is capable of variably determining the uppermost position of a wick to constantly carry out stable maximum combustion and exhibiting good operability and durability. The device is adapted to variably selectively form the detachable engagement between a stopper pin fixedly projecting a wick operating shaft and an adjusting member loosely fitted on the shaft to variably determine the uppermost position of a wick.

6 Claims, 4 Drawing Figures

DEVICE FOR ADJUSTING THE VERTICAL POSITION OF WICK IN OIL BURNER

BACKGROUND OF THE INVENTION

1. Field of the Invention

This invention relates to a device for adjusting the vertical position of a wick in a wick-ignition type oil burner, and more particularly to a wick adjusting device which is capable of readily varying the vertical position of a wick arranged in an oil burner when any accident occurs in maximum combustion, to thereby constantly carry out stable maximum combustion.

2. Description of the Prior Art

In a wick-ignition type oil burner, it is desired to determine the vertical position of a wick so as to allow stable maximum combustion to be constantly carried out. When the vertical position of the wick is too high, abnormal combustion generating fume often takes place. Whereas the too low position of the wick does not carry out combustion of desired heat value. However, the wick is gradually decreased in wicking ability with time, so that it is substantially difficult to carry out stable maximum combustion keeping the vertical position of the wick constant over a long period of time.

There have been conventionally proposed oil burners having various kinds of wick adjusting devices constructed to eliminate the forgoing defects, however, the conventional wick adjusting devices are bad in operability and durability.

Accordingly, it would be highly desirable to develop a device for adjusting the vertical position of a wick in an oil burner which is capable of readily adjusting the vertical position of a wick to allow stable maximum combustion to be constantly accomplished.

SUMMARY OF THE INVENTION

Accordingly, it is an object of the present invention to provide a device for adjusting the vertical position of a wick in a wick-ignition type oil burner which is capable of variably adjusting the vertical position of the wick with ease to allow stable maximum combustion to be constantly attained.

It is another object of the present invention to provide a device for adjusting the vertical position of a wick in a wick-ignition type oil burner which is compact in structure and can be readily manufactured.

It is a further object of the present invention to provide a device for adjusting the vertical position of a wick for an oil burner which is capable of exhibiting good operability and durability.

In accordance with the present invention, there is provided a device for adjusting the vertical position of a wick in an oil burner which is adapted to rotate a wick operating shaft having a knob provided at one end thereof to vertically move a wick, comprising a stopper means mounted on said wick operating shaft; an adjusting member adapted to be engaged with said stopper means to regulate the range of movement of said stopper means, said adjusting member being provided with a plurality of engagement means; at least one fixing means provided to be selectively engaged with at least one of said engagement means to keep said adjusting member at a stationary state; and a resilient means for forcing said adjusting member to ensure the engagement between said one of engagement means and said fixing means; said adjusting member being also adapted to be moved against said resilient means to release the engagement between said one of engagement means and said fixing means to allow at least another one of said engagement means to be engaged with said fixing means, so that the range of rotation of said wick operating shaft may be varied to variably determine the uppermost position of said wick.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a device for adjusting the vertical position of a wick in an oil burner according to the present invention will be described hereinafter with reference to the accompanying drawings.

Figure 1:
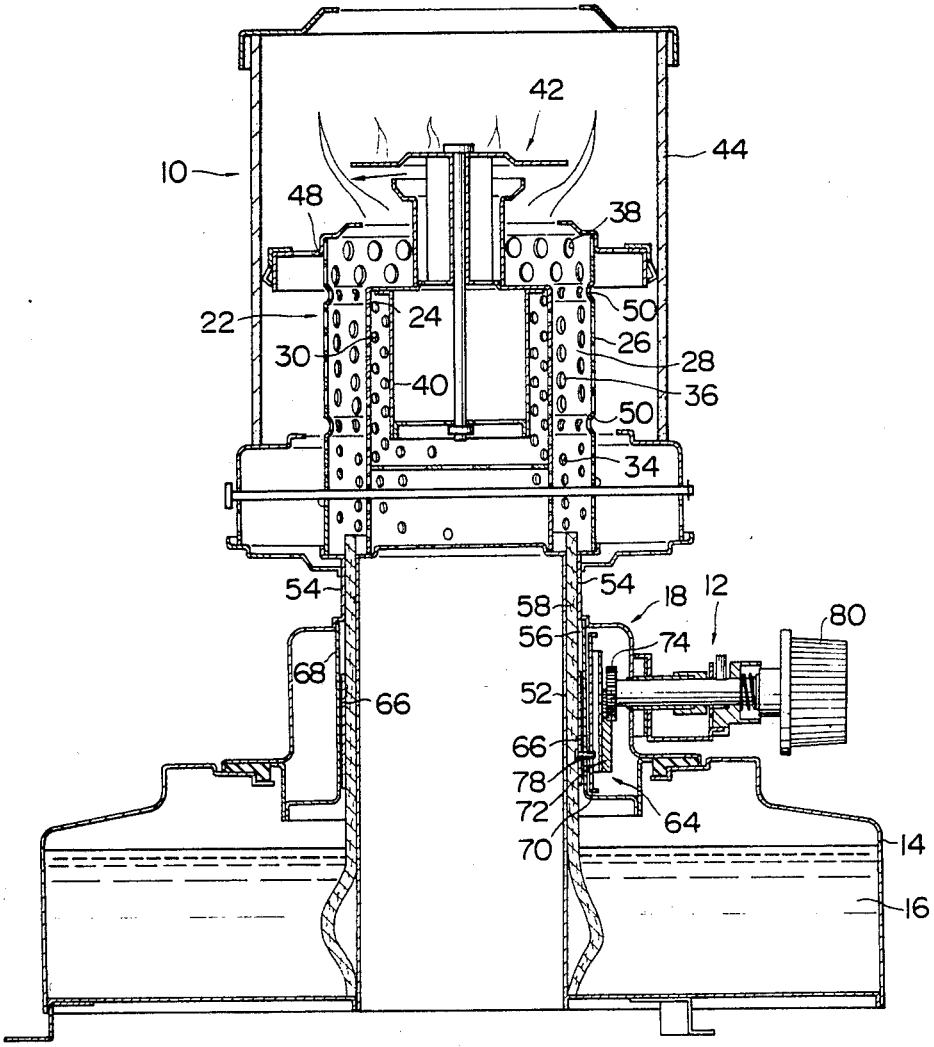
FIG. 1 is a vertical sectional view showing an oil space heater of the heat radiation type which has one embodiment of a device for adjusting the vertical position of a wick in an oil burner according to the present invention incorporated therein.

Referring first to FIG. 1, there is schematically illustrated a wick-ignition type oil burner generally designated by reference numeral 10 which is adapted to incorporate therein a device for adjusting the vertical position of a wick according to the present invention, wherein one embodiment of the present invention is generally designated by reference numeral 12. The oil burner illustrated in FIG. 1 is a red-hot type oil fired space heater. However, it should be noted that an oil burner in which a device for adjusting the vertical position of a wick according to the present invention is to be incorporated is not limited to such an oil fired space heater.

The oil burner 10 illustrated in FIG. 1 is constructed in such a manner as widely known in the art, except the device for adjusting the vertical position of a wick according to the present invention incorporated therein. The oil burner 10 includes an oil tank 14 for storing therein fuel oil 16 such as kerosine, a wick receiving cylinder 18 arranged on the tank 14, and a combustion cylinder construction 20 placed on the wick receiving cylinder 18.

The combustion cylinder construction 20 includes a double combustion cylinder 22 comprising an inner cylindrical member 24 and an outer cylindrical member 26 arranged concentrical with the inner cylindrical member 24 with a space 28 of a suitable interval being defined therebetween. The inner cylindrical member 24 is formed with a plurality of through-holes 30 which serve to introduce a part of combustion air from the lower portion of an internal cylindrical space 32 defined in the burner therethrough to the space 28. The outer cylindrical member 26 is also formed with a plurality of lower, middle and upper through-holes 34, 36 and 38. The upper and middle through-holes 36 and 38 are formed to have a size larger than the through-holes 30 of the inner cylindrical member 24. The inner cylindrical member 24 has a central cylinder 40 disposed therein, on which a flame spreading means 42 is mounted. The combustion cylinder construction 20 also includes a heat-permeable cylinder 44 supported through a non-permeable cylinder 46 on the wick receiving cylinder 18. The outer cylindrical member 26 is provided at the upper portion thereof with an annular top plate 48 which horizontally extends to the heat-permeable cylinder 44. The outer cylindrical member 26 also has recesses 50 of a semicircular in section provided circumferentially at the boundary portions between the lower through-holes 34 and the middle through-holes 36 and between the middle through-holes 36 and the upper through-holes 38. The recesses 50 each are provided with a plurality of through-holes.

The wick receiving cylinder 18 may be constructed in a manner as disclosed in U.S. Pat. No. 4,363,620 to Nakamura et al on Dec. 14, 1982. The wick receiving cylinder 18 has an inner wall 52 and an outer wall 54 which define therebetween an annular wick receiving chamber 56 communicated with the space 28 between the inner cylindrical member 24 and the outer cylindrical member 26. When combustion is to be carried out, a wick 58 is raised to the lower portion of the space 28 as shown in FIG. 1. Reference numeral 64 designates a wick actuating means for vertically moving the wick 58 supported on an annular retaining plate 66 which is disposed between the wick 58 and a lower wall member 68 of the outer wall 54 of the wick receiving cylinder 18 to lightly press the wick 58 against the inner wall 52 of the chamber 56. The wick actuating means 64 may be constructed in a manner as known in the art and comprises a plate 70 for rotating the wick retaining plate 66 which is arranged at the outside of the outer wall 54 of the wick receiving chamber 56 and adapted to circumferentially move, a rack 72 mounted on the plate 70 and a pinion 74 provided at one end of a wick operating shaft 76 so as to engage with the rack 72. The connection between the wick retaining plate 66 and the actuating plate 70 may be effected by means of a suitable conventional means such as a connecting pin 78.

The wick adjusting device 12 of the present invention is provided about the wick operating shaft 76 having a knob 80 provided at the other end thereof which acts to rotate the shaft 76 when it is manually operated or rotated. The wick adjusting device 12, as schematically shown in FIG. 1 and detailedly shown in FIGS. 2 and 3, includes a stopper pin 82 mounted on the wick operating shaft 76 so as to project outwardly therefrom or in the substantially radial direction thereof, an adjusting member 84 loosely fitted on the wick operating shaft 76 between the stopper pin member 82 and the knob 80, and a compression coiled spring 86 loosely fitted on the shaft 76 between the knob 80 and the adjusting member 84.

The adjusting member 84 comprises an annular member which is formed at one surface thereof with a circular recess 90 for receiving therein at least a part of the compression coiled spring 86 and at the other surface with a projection 92 of a substantially sector-shape. The sector-shaped projection 92 has both end faces 94 against which the stopper pin member 82 selectively abuts when the wick operating shaft 76 is rotated, so that the movement of the stopper pin is regulated within the range between the both end faces. The compression coiled spring serves to forcedly press the adjusting member 84 in the inward direction.

The device for adjusting the vertical position of a wick of the illustrated embodiment also includes a projection 96 fixedly provided at a burner body of the oil burner 10. In the illustrated embodiment, the projection 96 is integrally formed at the distal end of an extension member or spacer 98 of the burner body. Reference numeral 100 designates a plurality of recesses formed at the periphery of the sector-shaped projection 92 of the adjusting member 84 is a row. In the illustrated embodiment, the adjusting member 84 is formed with three recesses 100. The recesses 100 are adapted to allow the projection 96 of the spacer member 98 to be fittedly engaged with one of the recesses 100, so that the adjusting member 84 may be fixedly held or kept at a stationary state.

Figure 2:
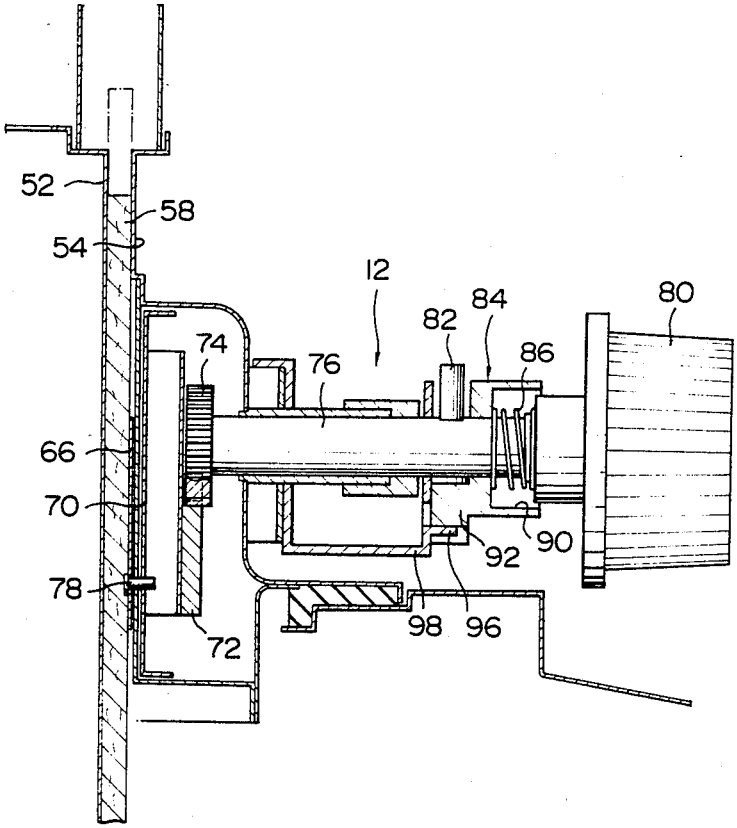
FIG. 2 is an enlarged side view of the device for adjusting the vertical position of a wick shown in FIG. 1.
Figure 3:
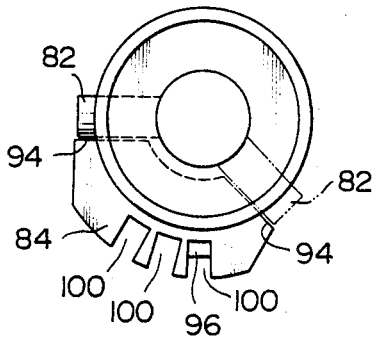
FIG. 3 is a schematic view showing the relationships among a stopper pin, an adjusting member and a projection acting as a fixing means in the device shown in FIG. 2.

The manner of operation of the device for adjusting the vertical position of a wick of the illustrated embodiment constructed as described above will be hereinafter described with reference to FIGS. 2 and 3.

When the knob 80 is rotated to upwardly move the wick 58, the stopper pin member 82 is abutted against one of the end faces 94 of the adjusting member 84 to stop the further rotation of the wick operating shaft 76, because the adjusting member 84 is fixedly held or kept at a stationary state by the secure engagement between the projection 96 of the spacer member 98 fixed on the burner body and one of the recesses 100 of the adjusting member 84 and the compression coiled spring 86 forcedly presses the adjusting member 84 in the inward direction to effectively prevent the disengagement between the projection 96 and the recess 100. This results in the upward movement of the wick 58 being stopped to limit the uppermost position of the wick to a constant level, although there is margin sufficient to allow the pinion 74 to be still rotated on the rack 72.

The uppermost position of the wick 58 once set is varied by manually forcing the adjusting member 84 against the compression coiled spring 86 in the outward direction to release the engagement between the the projection 96 and the recess 100 and then engaging the projection 96 with another one of the recesses 100. Such change in engagement between the projection 96 and the recesses 100 causes the relative position of the end surface 94 of the adjusting member 84 with respect to the stopper pin member 82 to be varied, to thereby vary the position at which the stopper pin 82 of the wick operating shaft 76 is to be stopped by the adjusting member 84.

Figure 4:
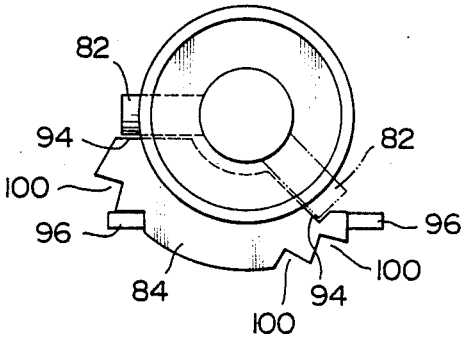
FIG. 4 is a schematic view showing the relationships among an adjusting member and projections acting as a fixed means in another embodiment of a device for adjusting the vertical position of a wick in an oil burner according to the present invention.

FIG. 4 shows the essential part of another embodiment of a device for adjusting the vertical position of a wick according to the present invention. The embodiment of FIG. 4 is adapted to be used in an oil burner in which the range of rotation of a wick operating shaft is narrowly determined, and is constructed in such a manner that two projections 96 are provided in a manner to be spaced from each other so that the corresponding two of recesses 100 are selectively engaged with the projections 96 as desired. Such construction allows the device for adjusting the vertical position of a wick to have more durability and be more stable in operation.

As can be seen from the foregoing, the device for adjusting the vertical position of a wick according to the present invention can highly readily determine the vertical position of a wick at a level sufficient to carry out stable maximum combustion by variably determining the position of the adjusting member in view of the state of combution flame. Also, the device for adjusting the vertical position of a wick according to the present invention can be manufactured with ease because the adjusting mechanism is compactly arranged about the wick operating shaft. Furthermore, the present invention allows an operator to rapidly and effectively notice the stop of upward movement of a wick, different from a conventional device for adjusting the vertical position of a wick which is constructed to provide a wick retaining cylinder or plate with a stopper; because a shock at the stop of upward movement of a wick is transmitted through the knob of the wick operating shaft directly to the operator. Thus, it will be noted that the present invention effectively prevents troubles such as a damage of the stopper member due to the forcible rotation of the wick operating shaft by an error and exhibits good operability and durability.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A device for adjusting the vertical position of a wick in an oil burner which is adapted to rotate a wick operating shaft having a knob provided at one end thereof to vertically move a wick, comprising:

a stopper means mounted on said wick operating shaft;

an adjusting member positioned to be engaged with said stopper means so as to regulate the range of movment of said stopper means, said adjusting member being provided with a plurality of engagement means;

at least one fixing means positioned to be selectively engaged with at least one of said engagement means so as to keep said adjusting member at a stationary state; and a resilient means resiliently forcing said adjusting member into a position providing the engagement between said at least one of said engagement means and said fixing means;

said adjusting member being also adapted to be moved against said resilient means to release the engagement between said at least one of said engagement means and said fixing means and to allow at least another one of said engagement means to be engaged with said fixing means, so that the range of rotation of said wick operating shaft may be varied to variably determine the uppermost position of said wick.

2. A device for adjusting the vertical position of a wick as defined in claim 1, wherein said stopper means comprises a rod member mounted on said wick operating shaft to outwardly project from said shaft.

3. A device for adjusting the vertical position of a wick as defined in claim 2, wherein said adjusting member is loosely fitted on said wick operating shaft and said resilient means comprises a compression coiled spring fitted on said wick operating shaft between said knob and said adjusting member.

4. A device for adjusting the vertical position of a wick as defined in claim 3, wherein said adjusting member comprises an annular member having one surface provided with a substantially sector-shaped projection;

said plurality engagement means comprise a plurality of recesses formed at the periphery of said sector-shaped projection; and said fixing means comprises a projection provided on a burner body of said oil burner and adapted to be fittedly engaged with one of said recesses.

5. A device for adjusting the vertical position of a wick as defined in claim 1, wherein two of said fixing means are provided in spaced relation from each other, and said two fixing means are selectively engaged with corresponding two of said engagement means.

6. A device for adjusting the vertical position of a wick in an oil burner which is adapted to rotate a wick operating shaft having a knob provided at one end thereof to vertically move a wick, comprising:

a stopper member mounted on said wick operating shaft to outwardly project from said shaft;

an adjusting member loosely fitted on said wick operating shaft and adapted to be engaged with said stopper member to stop the vertical movement of said wick at a height sufficient to carry out stable maximum combustion when said wick operating shaft is rotated in the direction of upward moving said wick, said adjusting member comprising an annular member provided with a substantially sector-shaped projection which is formed at the periphery thereof with a plurality of recesses;

a fixing means comprising a projection provided on a burner body of said oil burner and adapted to be selectively engaged with one of said recesses of said sector-shaped projection of said adjusting member to keep said adjusting member at a stationary state; and a compression coiled spring fitted on said wick operating shaft between said knob and said adjusting member to force said adjusting member to ensure the engagement between said one of said recesses and said fixing means;

said adjusting means being also adapted to be moved against said compression coiled spring to release the engagement between said one of said recesses and said fixing means to allow another one of said recesses to be engaged with said fixing means, so that the range of rotation of said wick operating shaft may be varied to variably determine the uppermost position of said wick.

* * * * *